US008393501B2

(12) United States Patent
Herman et al.

(10) Patent No.: US 8,393,501 B2
(45) **Date of Patent: *Mar. 12, 2013**

(54) DISPENSING TOOL

(75) Inventors: Timm Herman, Eillicottville, NY (US); Kevin Whited, Ellicottville, NY (US)

(73) Assignee: Meritool LLC, Ellicottville, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/193,725

(22) Filed: Jul. 29, 2011

(65) Prior Publication Data

US 2011/0278327 A1 Nov. 17, 2011

Related U.S. Application Data

(63) Continuation of application No. 11/973,242, filed on Oct. 5, 2007, now Pat. No. 8,011,538.

(60) Provisional application No. 60/902,443, filed on Feb. 21, 2007.

(51) Int. Cl.
*B65D 88/54* (2006.01)

(52) U.S. Cl. ..... 222/326; 222/333; 222/386; 222/1; 29/402.08

(58) Field of Classification Search ..... 222/326, 222/333, 327, 325, 386, 390, 1; 29/402.08
See application file for complete search history.

(56) References Cited

U.S. PATENT DOCUMENTS

| | | | | |
|---|---|---|---|---|
| 3,750,905 | A * | 8/1973 | Wolfrom | 222/23 |
| 4,260,076 | A | 4/1981 | Bergman | |
| 4,583,934 | A | 4/1986 | Hata et al. | |
| 4,669,636 | A | 6/1987 | Miyata | |
| 5,076,473 | A | 12/1991 | Steiner | |
| 5,211,312 | A * | 5/1993 | Chang | 222/153.01 |
| 5,244,406 | A | 9/1993 | Vranish | |
| 5,370,271 | A * | 12/1994 | Segatz | 222/95 |
| 5,375,740 | A | 12/1994 | Umetsu et al. | |
| 5,450,988 | A * | 9/1995 | Jerdee | 222/333 |
| 5,494,368 | A | 2/1996 | Matthews | |
| 5,556,009 | A * | 9/1996 | Motzko | 222/326 |
| 5,775,539 | A | 7/1998 | Bates et al. | |
| 5,873,970 | A | 2/1999 | Konuma et al. | |
| 5,887,765 | A | 3/1999 | Broesamle | |
| 5,909,830 | A | 6/1999 | Bates et al. | |
| 6,286,729 | B1 | 9/2001 | Lin | |
| 6,701,828 | B1 * | 3/2004 | Burns et al. | 99/450.2 |
| 6,745,921 | B2 * | 6/2004 | Beckett | 222/391 |

(Continued)

FOREIGN PATENT DOCUMENTS

| | | |
|---|---|---|
| EP | 1233210 | 8/2002 |
| JP | 11333346 | 12/1999 |

OTHER PUBLICATIONS

European Search Report, 7 pages, dated Nov. 3, 2011 for EP Application No. EP11179374.1.

(Continued)

*Primary Examiner* — Kevin P Shaver
*Assistant Examiner* — Donnell Long
(74) *Attorney, Agent, or Firm* — Tarolli, Sundheim, Covell & Tummino, LLP

(57) ABSTRACT

An apparatus for dispensing material is provided having a body portion and housing for supporting cartridges filled with materials for dispensing. The housing includes a dispensing end, an attachment end, and an elongated opening for receiving the cartridges. The apparatus further comprises an attachment assembly located at an end of the body portion for attaching the housing to the body portion. The attachment assembly includes a first set of threads located about the perimeter of the attachment assembly. A second set of threads are located about the perimeter of the attachment end of the housing for engaging the first set of threads, forming a threaded connection and attaching the housing to the body portion.

20 Claims, 6 Drawing Sheets

U.S. PATENT DOCUMENTS

| | | | | |
|---|---|---|---|---|
| 6,752,293 | B2 * | 6/2004 | So | 222/156 |
| 6,889,872 | B2 | 5/2005 | Herman et al. | |
| 6,926,177 | B1 * | 8/2005 | Scott et al. | 222/390 |
| 7,063,240 | B1 * | 6/2006 | Niswonger | 222/391 |
| 7,192,267 | B2 * | 3/2007 | Glucksman et al. | 425/376.1 |
| 2002/0036214 | A1 | 3/2002 | Rousselet et al. | |
| 2002/0117016 | A1 * | 8/2002 | Beckett | 74/111 |
| 2005/0051571 | A1 | 3/2005 | Carruth et al. | |
| 2008/0083845 | A1 | 4/2008 | Lind et al. | |
| 2009/0277970 | A1 * | 11/2009 | Lind et al. | 239/3 |
| 2009/0302055 | A1 | 12/2009 | Cadden et al. | |
| 2011/0155758 | A1 | 6/2011 | Johnson | |

OTHER PUBLICATIONS

International Search Report, 7 pages, dated Jun. 10, 2008 for International Application No. PCT/US2007/024785.

Milwaukee 14.4V Cordless Caulk & Adhesive Gun Kits, Online Product Sheet, Jun. 25, 2006 (date according to waybackmachine.com) {Retrieved on May 13, 2008} Retrieved from the Internet <URL:http://www.mytoolstore.com/milwauke/6562-21.html>, 6 pages.

Exploded View and Service Parts List for 14.4V Cordless Caulk Gun, Catalog No. 6562-21, Serial No. A63A, 2 pages. To the best of Applicant's knowledge, the product shown and described was on sale in the U.S. more than one-year prior to the filing date of the present application.

Exploded View and Service Parts List for 14.4V Cordless Caulk Gun, Catalog No. 6562-24, Serial No. A93A, 2 pages. To the best of Applicant's knowledge, the product shown and described was on sale in the U.S. more than one-year prior to the filing date of the present application.

Exploded View and Service Parts List for 14.4V Cordless Caulk Gun, Catalog. No. 6562-23, Serial No. A92A, 2 pages. To the best of Applicant's knowledge, the product shown and described was on sale in the U.S. more than one-year prior to the filing date of the present application.

Milwaukee 12 Volt Cordless Caulk and Adhesive Guns Advertisement, 2 pages. To the best of Applicant's knowledge, the product shown and described was on sale in the U.S. more than one-year prior to the filing date of the present application.

Milwaukee Operator's Manual for 14.4V Caulk and Adhesive Gun, 40 pages. To the best of Applicant's knowledge, the product shown and described was on sale in the U.S. more than one-year prior to the filing date of the present application.

Exploded View and Service Parts List for 14.4V Cordless Caulk Gun, Catalog No. 6562-21, Serial No. A63A, 2 pages. This product as shown and described was on sale in the U.S. on or before Feb. 1, 2006.

Exploded View and Service Parts List for 14.4V Cordless Caulk Gun, Catalog No. 6562-24, Serial No. A93A, 2 pages. This product as shown and described was on sale in the U.S. on or before Feb. 1, 2006.

Exploded View and Service Parts List for 14.4V Cordless Caulk Gun, Catalog No. 6562-23, Serial No. A92A, 2 pages. This product as shown and described was on sale in the U.S. on or before Feb. 1, 2006.

Milwaukee 12 Volt Cordless Caulk and Adhesive Guns Advertisement, 2 pages. This product as shown and described was on sale in the U.S. on or before Feb. 1, 2006.

Milwaukee Operator's Manual for 14.4V Caulk and Adhesive Gun, 40 pages. This product as shown and described was on sale in the U.S. on or before Feb. 1, 2006.

* cited by examiner

DISPENSING TOOL

CROSS-REFERENCES TO RELATED APPLICATIONS

This application is a continuation application of, and claims priority to, currently pending U.S. patent application Ser. No. 11/973,242 filed Oct. 5, 2007 entitled DISPENSING TOOL that was published on Aug. 21, 2008 under publication number US 2008/0197154, which claims priority to U.S. provisional application Ser. No. 60/902,443 that was filed on Feb. 21, 2007. The present application claims priority to the above-identified patent applications that are incorporated in their entirety herein by reference for all purposes.

TECHNICAL FIELD

The present invention relates to a dispensing tool, and is particularly directed to a power dispensing tool have a quick connect cartridge support assembly.

BACKGROUND

It is common practice for a user to own several different sizes of manual dispensing guns for dispensing materials, such as adhesives, lubricants, and sealants, for example silicone and caulk. One reason for owning several different sizes of manual dispensing guns is to accommodate different sizes of cartridges. It is impractical because of the cost associated with power dispensing guns to own or purchase several different sizes in order to accommodate the different sizes of cartridges.

SUMMARY OF THE INVENTION

In accordance with one exemplary embodiment of the present invention is an apparatus for dispensing materials having a body portion and housing for supporting cartridges filled with materials for dispensing. The housing includes a dispensing end, an attachment end and an elongated opening for receiving the cartridges. The apparatus further comprises an attachment assembly located at an end of the body portion for attaching the housing to the body portion. The attachment assembly includes a first set of threads located about the perimeter of the attachment assembly. A second set of threads are located about the perimeter of the attachment end of the housing for engaging the first set of threads, forming a threaded connection and attaching the housing to the body portion. A locking assembly secures the threaded connection between the first set of threads and the second set of threads to a locked position.

In accordance with another exemplary embodiment of the present invention is a dispensing tool for dispensing materials comprising a housing for supporting cartridges filled with materials for dispensing. The housing has a dispensing end and an attachment end. The dispensing tool further includes a body portion having an attachment assembly comprising a cap, washer, and connector for attaching the housing to the body portion. The cap has a first set of threads and the connector comprises a threaded portion that extends through openings in the washer and the cap into a corresponding threaded area of the body portion for attaching the washer and cap to the body portion. A second set of threads are located about the perimeter of the attachment end of the housing for engaging the first set of threads, forming a threaded connection and attaching the housing to the body portion. A locking assembly is provided for securing the threaded connection between the first set of threads and the second set of threads to a locked position.

In accordance with a further exemplary embodiment of the present invention is a power dispensing tool for dispensing materials comprising a body portion having a handle, trigger, engagement member, and elongated rod connected to a piston such that advancement of the trigger advances the elongated rod through the body portion for the dispensing of material from the power dispensing tool. The dispensing tool further comprises a cartridge support tube for housing materials for dispensing. The cartridge support tube has a dispensing end and an attachment end. An attachment assembly comprising a cap, washer, and connector is provided for attaching the cartridge support tube to the body portion. The cap has a first set of threads about its internal perimeter. The connector has a threaded portion that extends through openings in the washer and the cap into a corresponding threaded area of the body portion engagement member for attaching the washer and cap to the body portion. A second set of threads are located about the external perimeter of the attachment end of the cartridge support tube for engaging the first set of threads, forming a threaded connection and attaching the cartridge support tube to the body portion. The power dispensing tool further includes a locking assembly for securing the threaded connection between the first set of threads and the second set of threads to a locked position. The locking assembly comprising a projection fixedly attached to the cartridge support tube and an opening located in the attachment assembly such that the projection penetrates the opening when in the locked position.

BRIEF DESCRIPTION OF THE DRAWINGS

The foregoing and other features and advantages of the present invention will become apparent to one skilled in the art to which the present invention relates upon consideration of the following description of the invention with reference to the accompanying drawings, in which.

DETAILED DESCRIPTION OF THE PREFERRED EMBODIMENTS

Figure 1:
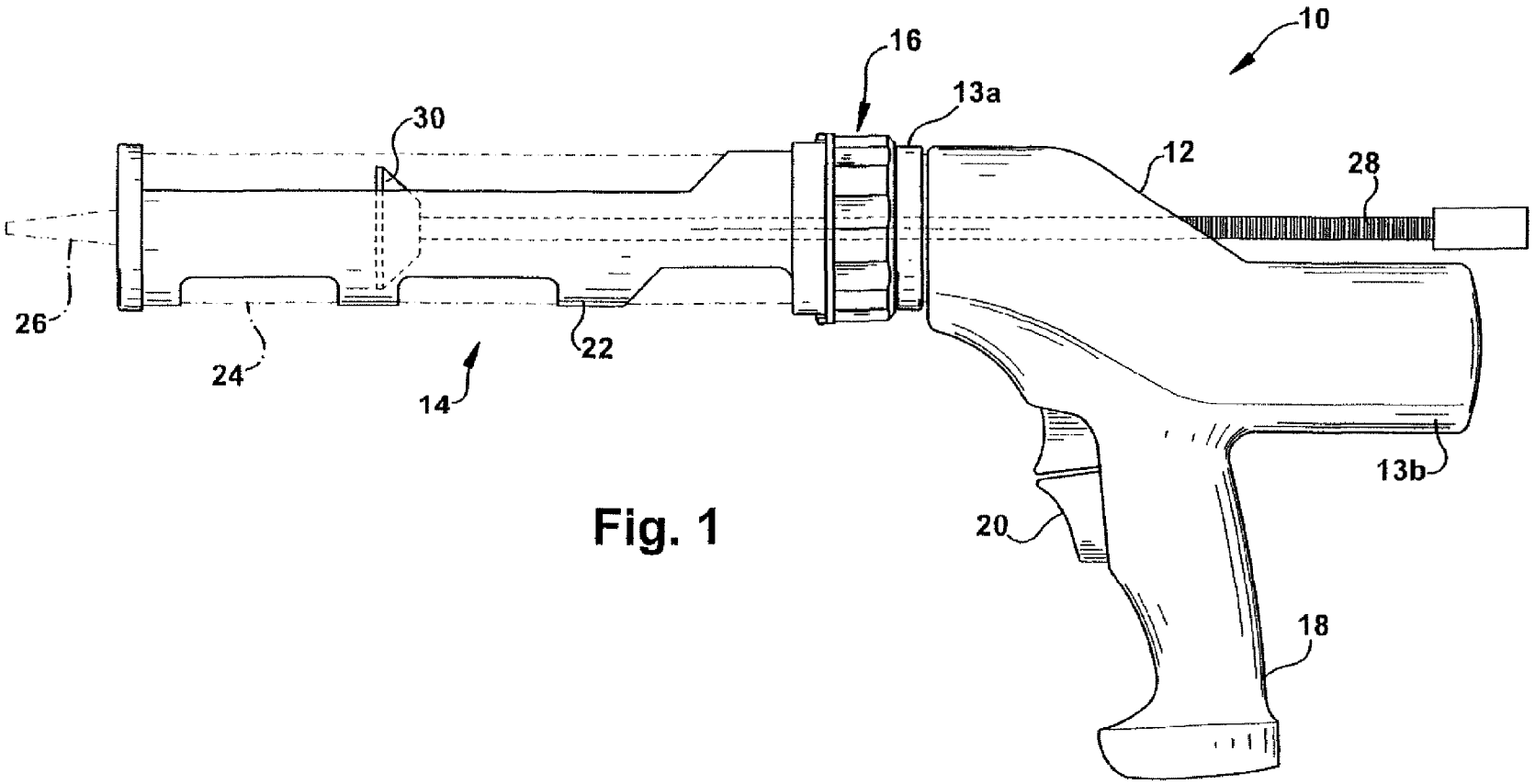
FIG. 1 is an elevation view of a dispensing tool, the tool being equipped with a cartridge support assembly in accordance with one example embodiment of the present invention.

FIG. 1 illustrates a dispensing tool 10 having a body 12 and a cartridge support assembly 14. The cartridge support assembly 14 is attached to the body 12 through its locking assembly 16. The body 12 includes first and second ends 13*a*, 13*b*, respectively, a handle portion 18, and a trigger 20 projecting from the handle portion for engagement by an operator of the dispensing tool 10. The cartridge support assembly 14 further includes a cartridge support tube 22 for supporting a cartridge 24 (shown in phantom) having a dispensing nozzle 26 (also shown in phantom) for dispensing any number of materials, including, but not limited to, adhesives, lubricants, and sealants. The cartridge support tube 22 in the illustrated embodiment of FIG. 1 is molded from a polymeric material, but could also be made from metal and from any other process without departing from the spirit and scope of the claimed invention.

An elongated rod 28 extends from the body 12 and is axially advanced through the body into the cartridge support assembly 14 and cartridge 24 upon activation of the trigger 20. A piston 30 is connected to a forward end of the rod 28, such that axial movement of the rod will cause comparable axial movement of the piston, resulting in the dispensing of material from dispensing nozzle 26 of the cartridge 24 upon advancement.

Motion enabling mechanisms of the rod 28 and piston 30, such as an electric motor, controls and gearing are located within the body for advancement and retraction the rod and piston. In the illustrated embodiment the rod 28 includes a rack or tooth portion for engagement by a pinion of a gear assembly (not shown). Upon engagement of the trigger 20 an internal motor (not shown) would provide movement in the gear assembly, engaging the rod 28 for either advancement or retraction of the rod through the body 12. The motion enabling mechanisms for advancing and retracting the rod 28 and piston 30 through the body 12 could alternatively be achieved by other constructions known by those skilled in the art, such as a screw-gear assembly without departing from the spirit and scope of the claimed invention.

Figure 2:
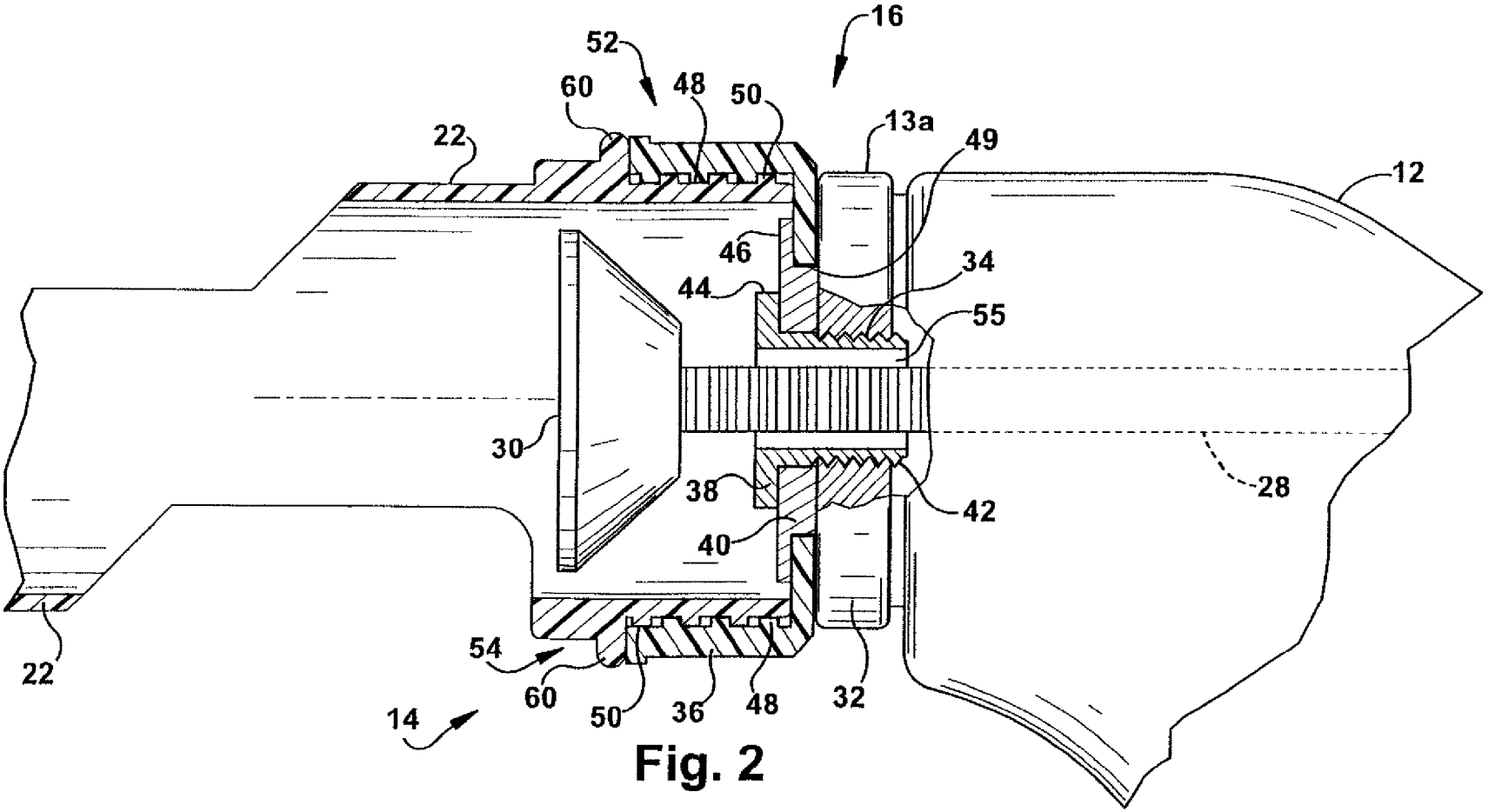
FIG. 2 is a partial-sectional elevation view of a cartridge support assembly attached to the body of the dispensing tool of FIG. 1.

Turning now to FIG. 2 is a partial sectional elevation view of the cartridge support assembly 14 attached to the body 12 of the dispensing tool 10 of FIG. 1. Integrally connected to the body 12 at the first end 13*a* is an engagement member 32 that includes internally tapped threads 34. The locking assembly 16 includes a rotatable cap 36, connector 38, and a step washer 40. The step washer 40 can be made from a metal or polymeric material and is coated with an anti-friction coating to allow for rotation of the cartridge 24, cartridge support tube 22, and rotatable cap 36 during operation. It is desirable to allow the operator of the dispensing tool 10 to rotate the cartridge support assembly 14 and cartridge 24 relative to the body 12 in order to achieve various angles of the dispensing nozzle 26 during application of the dispensing material. Examples of suitable anti-frictional coatings include silicone and Teflon plating. In addition, such construction requires only the cap 36 to rotate in order to attach the cartridge support assembly 14 to the body 12.

The connector 38 includes a threaded member 42 for engaging the engagement member 32 through the mating thread 34 connection. The connector 38 further includes an annular flange 44 that holds the step washer 40 in a secured position. The step washer 40 includes a circular flange 46 for retaining the rotatable cap 36 to the body 12. The anti-friction coating applied to the step washer 40, particularly on the surface of the circular flange 46 facing the rotatable cap 36 enables the desired rotation of the cap 36, cartridge support tube 22, and cartridge 24. The rotatable cap 36 includes receiving threads 48 located about the cap's internal perimeter and a circular opening 49 in which the connector 38 and at least a portion of the step washer 40 passes, permitting attachment of the connector and step washer to the body 12.

Figure 6:
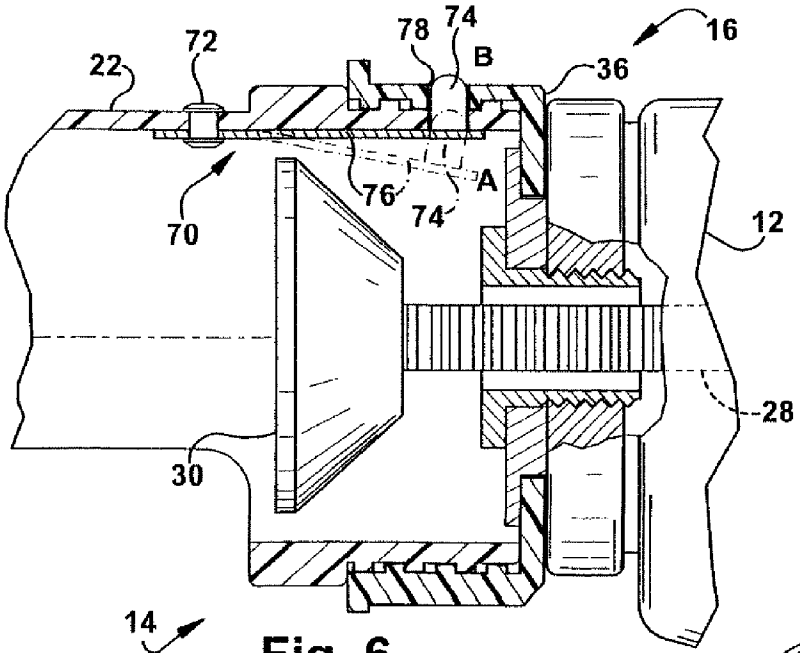
FIG. 6 is a partial-sectional elevation view of a cartridge support assembly attached to the body of the dispensing tool in accordance with another example embodiment of the present invention.

The cartridge support tube 22 includes attachment threads 50 located at an attachment end 52 of the cartridge support assembly 14. The cartridge support assembly 14 is attached to the body 12 through a threaded assembly 54 that includes the connection between attachment threads 50 and corresponding receiving threads 48 located in the rotating cap 36 as best illustrated in FIGS. 2 and 6. The connector 38 provides a clearance opening 55 for the passing of the elongated rod 28.

Figure 3A:
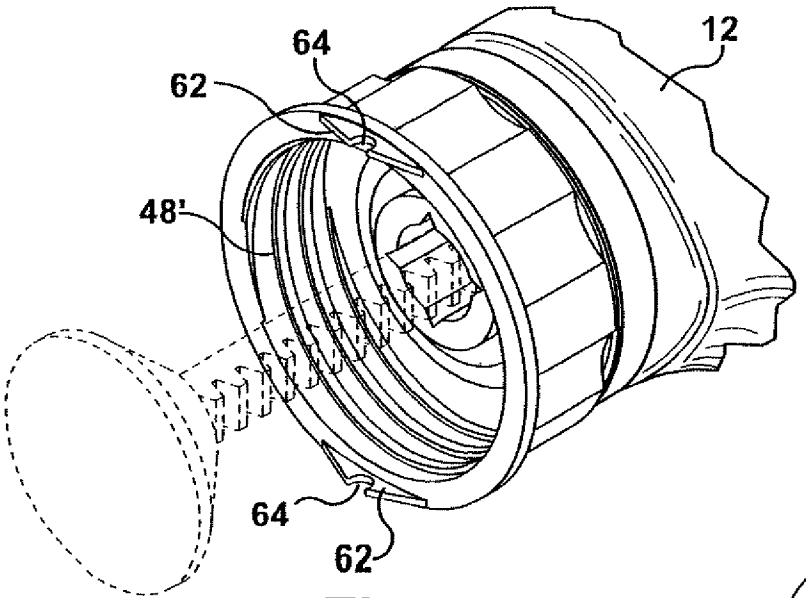
FIG. 3A is a partial isometric view of a dispensing tool body end depicting a locking assembly in accordance with one example embodiment of the present invention.

The threaded assembly 54 in one example embodiment includes a single-lead threaded connection, as depicted by the receiving threads 48' in FIG. 3A. The single-lead thread requires approximately 360 degrees of rotation for complete engagement. In a separate example embodiment the threaded assembly 54 includes a double-lead threaded connection, as depicted by the receiving threads 48" in FIG. 3B requiring half of the rotation necessary for a single-lead thread, that is, approximately 180 degrees of rotation for complete engagement. The threaded assembly 54 connection allows the cartridge support tubes 22 to be interchanged with different support tube sizes rapidly without the use or need for additional tools.

Figure 4:
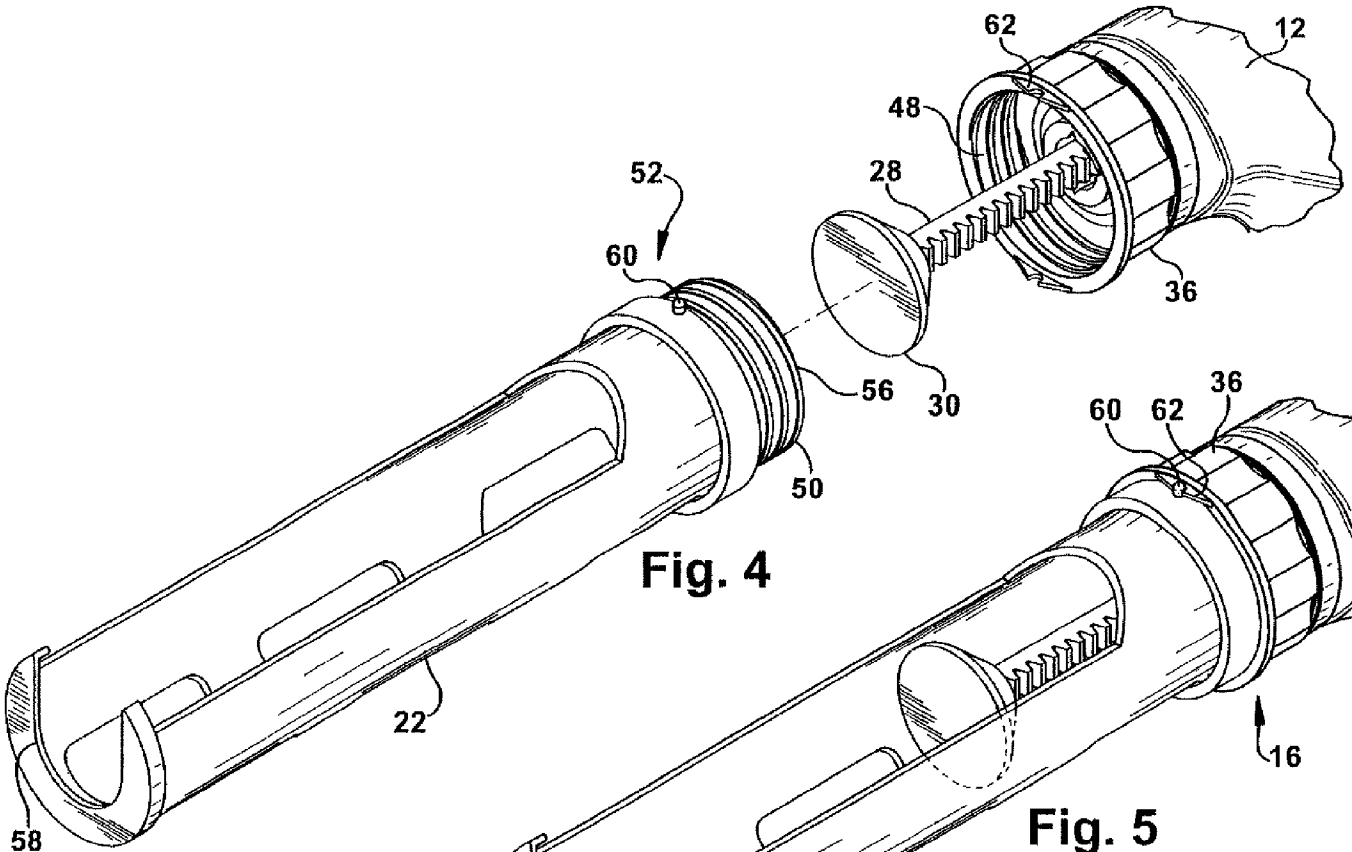
FIG. 4 is an exploded isometric assembly view of the dispensing tool of FIG. 1.
Figure 5:
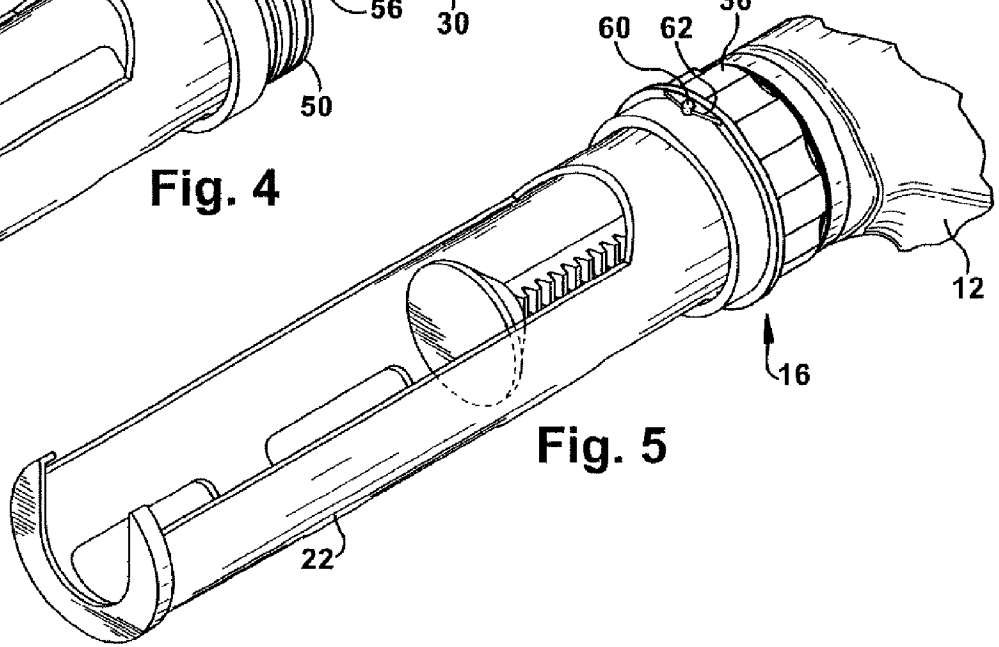
FIG. 5 is a partial isometric view of the dispensing tool of FIG. 4.

FIG. 4 is an exploded isometric assembly view of the dispensing tool 10 of FIG. 1. The cartridge support tube 22 provides an opening 56 at the attachment end 52 for receiving the piston 30, allowing the piston to remain attached to the elongated rod 28 for quick interchanging between support tubes 22. Located at the end opposite the attachment end 52 of the support tube 22 is a slot 58 for receiving the cartridge nozzle 26 upon insertion of the cartridge 24 to the support tube as depicted in FIG. 1. FIG. 5 illustrates the cartridge support tube 22 in an attached position with the body 12.

Figure 3B:
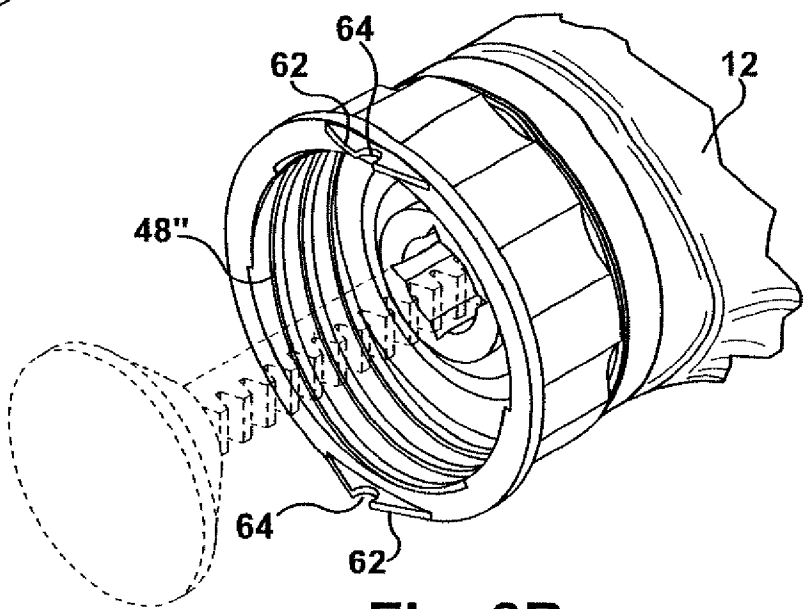
FIG. 3B is a partial isometric view of a dispensing tool body end depicting a locking assembly in accordance with another example embodiment of the present invention.

Referring again to FIG. 2 is one example embodiment of the locking assembly 16 that additionally includes two projections 60, substantially diametrically opposed about the perimeter of the attachment end 52 of the cartridge support tube 22. In the illustrated embodiment the projections 60 are integrally molded with the cartridge support tube 22. The projections 60 contact one side of a respective double inclined latch 62 upon concomitant rotation of the cartridge support tube 22 and/or rotating cap 36 in forming the threaded assembly 54 until engagement is complete. In the illustrated embodiment the double inclined latches 62 are integrally molded with, and extending from the polymeric cap 36. Upon completion of engagement of the threaded assembly 54, the projections 60 are received in a respective arcuate detents 64 (as best seen in FIGS. 3A and 3B) located between the inclines of the latches 62, arriving in a locking position as best seen in FIG. 5. The locking position prevents the disengagement of the threaded assembly 54 and more specifically, the disengagement of the cartridge support tube 22 from the rotating cap 36, unless intentionally acted upon by the user. In order to release the locking assembly 16 from the locking position illustrated in FIG. 5, the projections 60 and/or latches 62 have an elastic composition that allows for displacement from the locking position with the application of force by the user while simultaneously rotating the support tube 22 from the rotating cap 36. In the illustrated example embodiment, the projections 60 and inclined latches 62 are made from a polymeric material, but could also be made from metal or any other material without departing from the spirit and scope of the claimed invention.

FIG. 6 illustrates a second example embodiment of the locking assembly 16 that includes a spring assembly 70 having a first end attached to the cartridge support tube 22 by a fastener 72, such as a rivet or screw or other fasteners recognized by those skilled in the art. At an end of the spring assembly 70 opposite the fastener 72 is a locking protrusile 74, which is attached to, and projects from a spring 76 of the spring assembly. The spring assembly 70 assumes a non-locking position "A" (shown in phantom) prior to engagement of the threaded assembly 54 and during rotation of the support tube 22 and/or rotating cap 36 in the forming of the threaded assembly. Upon completion of the engagement of the threaded assembly 54, the protrusile 74 extends through an aperture 78 of the cap 36 assuming a locking position "B". The spring assembly 70 is made from a polymeric material in the illustrated embodiment, but could equally be made from a metal, including for example spring steel.

The locking position B prevents the cartridge support tube 22 from disengaging the cap 36 unless intentionally acted upon by the user. In order to release the locking assembly 16 of FIG. 6, the user depresses the protrusile 74 from position B to position A while simultaneously rotating the cap 36 from the support tube 22. The protrusile 74 and spring 76 are made from plastic, but could also be made from metal or any other material without departing from the spirit and scope of the claimed invention.

Figure 7:
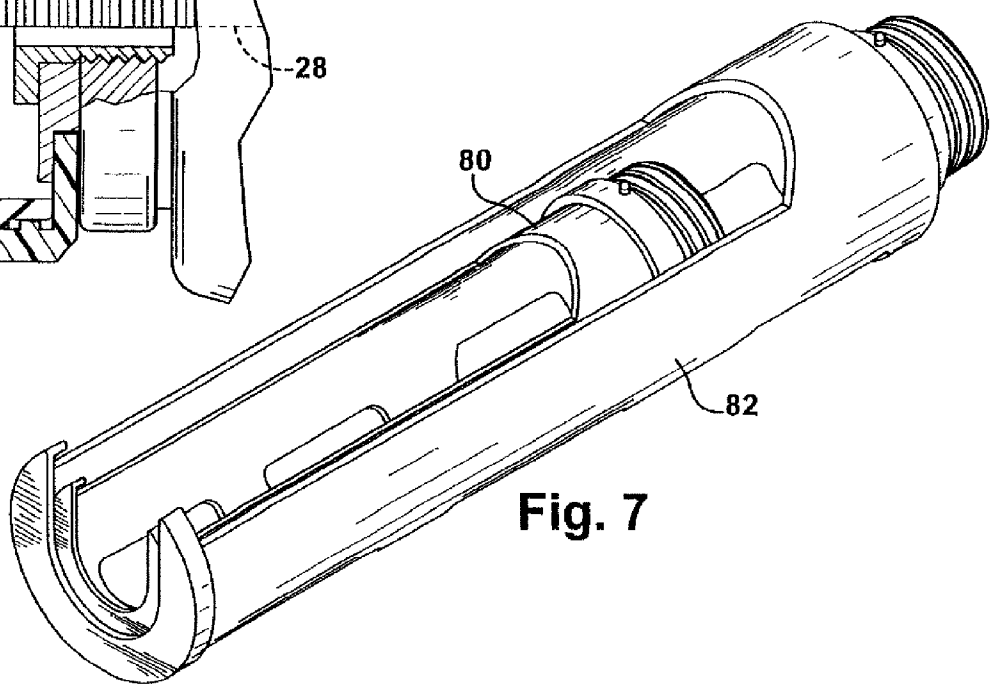
FIG. 7 is an isometric view of two cartridge support tubes in a nested storage position.
Figures 8A, 8B, 8C:
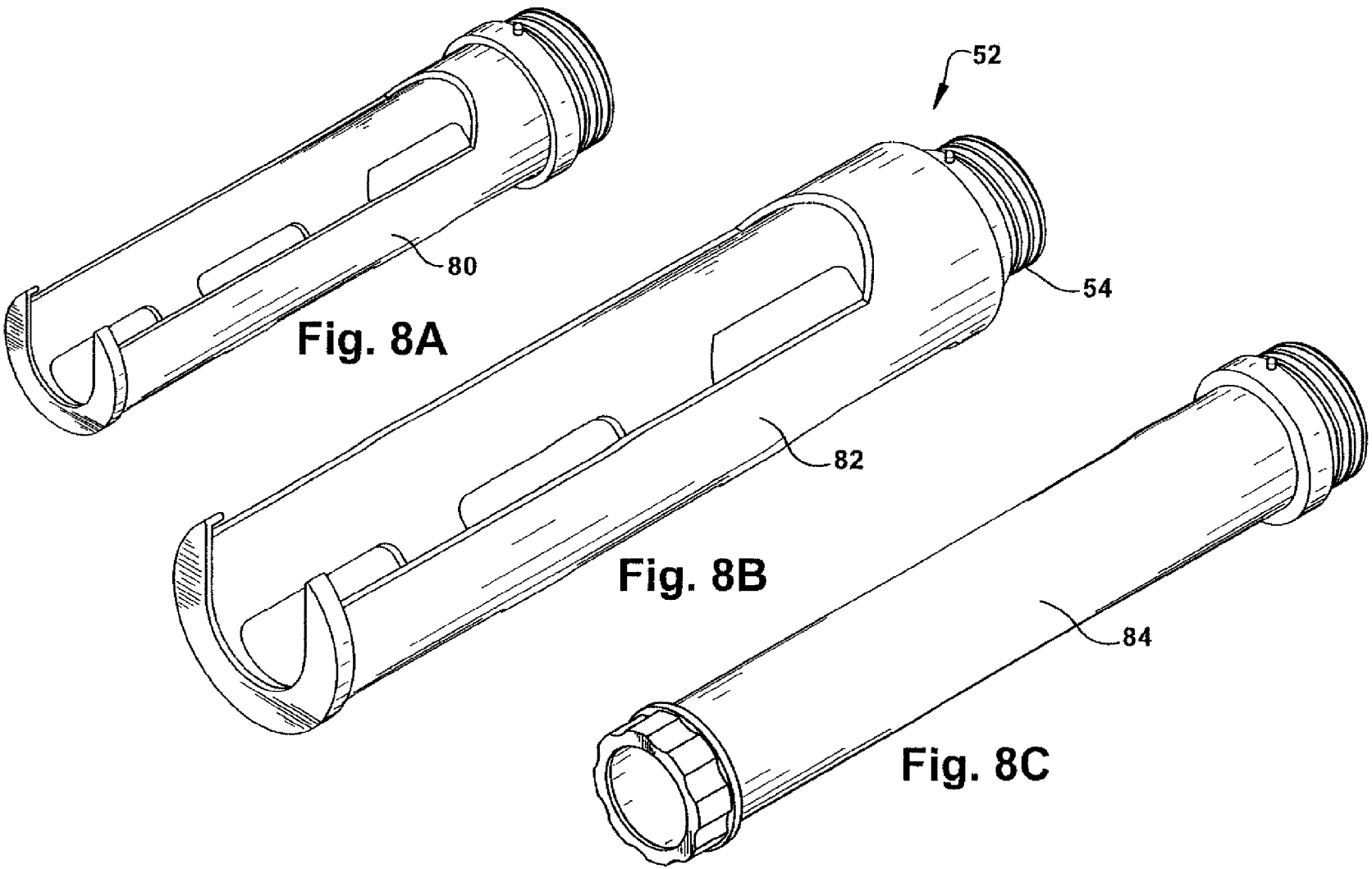
FIGS. 8A-8C are isometric views of different sized cartridge support tubes.

FIGS. 7 and 8A-8C illustrate a variety of cartridge support tubes 80, 82, and 84 of varying sizes, materials and configurations. Cartridge support tube 80 is the smallest of the tubes and is used for approximately 300 milliliter sized cartridges. Cartridge support tube 82 is relatively greater in size and is used for approximately 29 ounce sized cartridges. The cartridge support tube 84 is a sausage type configuration and is used for approximately 300 milliliter and 600 milliliter sized cartridges. All three cartridges include the attachment assembly 54 described above and are capable of being equipped with the different locking assembly 16 embodiments previously discussed. In particular, the support tubes 80-82 are shown having a projection 60 type locking assembly. As illustrated in FIGS. 8A-8C, varying size cartridge support tubes 22 maintain equally sized attachment ends 52 for accommodating uniform threaded assembly 54 attachments. Such construction allows any size cartridge support tube 22 to be used without departing from the spirit and scope of the claimed invention. In the illustrated embodiments of FIGS. 8A and 8B the cartridge support tubes are single-piece molded from a polymeric material and support tube 84 is made from a metal. However, the cartridge support tubes 14, 80-84 can be made from any type of material without departing from the spirit and scope of the claimed invention.

FIG. 7 illustrates a nesting feature between two different sized cartridge support tubes that allows for efficient storage achieved by the design of the claimed invention. Molded features can be added to lock the smaller cartridge tube 80 to the larger tube 82. For example, clips or other locking attachments could be molded such that the larger cartridge tube 82 would have a mating structure for engaging or receiving a corresponding structure in the smaller cartridge support tube 80. The smaller cartridge tube 80 can also be used while in the nested position of FIG. 7. In particular, the smaller cartridge tube 80 can contain a cartridge 24 and be simultaneously secured to the larger cartridge tube 82 in a manner described above, allowing the piston 30 to pass through both the larger and smaller tubes and dispense material from a cartridge 26 positioned in the smaller cartridge tube 80.

From the description of the invention, those skilled in the art will perceive improvements, changes and modifications. In addition to the dispensing tool 10 having a cartridge support tube 22 and locking assembly 16 fabricated from molded polymeric material, one skilled in the art will appreciate that support tube and locking assembly are equally suited for being made from other integrally molded or separate materials without departing from the spirit and scope of the claimed invention. For example, the support tubes 22 and locking assemblies 16 could be made from various metals. Such improvements, changes, and modifications within the skill of the art are intended to be covered by the appended claims.

We claim:

1. A power operated dispensing tool for dispensing material comprising:

a body portion for supporting a rod connected to a piston for engaging and advancing material from the power operated dispensing tool during operation;

a selected one of a plurality of different sized housings having differing lengths and outer housing profiles of both uniform and perforated shapes for supporting varying size and different shapes of material containers types during use, the plurality of different sized housings further having a dispensing end and an attachment end; and a uniformly sized attachment assembly for tool-free connecting of said plurality of different sized housings to said body portion, the attachment assembly comprising a first connecting arrangement located on all of said plurality of different sized housings at said attachment end and a second connecting arrangement located at said front side of said body portion, the first connecting arrangement comprising a first set of threads annularly located about a surface of said first connecting arrangement and the second connecting arrangement comprising a second set of threads annularly located about a surface of said second connecting arrangement, the first and second set of threads forming a threaded connection allowing for the attachment of any one of said plurality of different sized housings to said body portion.

2. The power operated dispending tool of claim 1 wherein said selected one of a plurality of different sized housings comprises a sausage type housing.

3. The power operated dispensing tool of claim 1 wherein said selected one of a plurality of different sized housings comprises an elongated opening for receiving the cartridges.

4. The power operated dispensing tool of claim 1 wherein said selected one of a plurality of different sized housings comprises a housing having a diameter that is larger than a diameter forming an outer diameter of said first connecting arrangement.

5. The power operated dispensing tool of claim 1 wherein said selected one of a plurality of different sized housings comprises a housing having a diameter substantially the same as a diameter forming an outer diameter of said first connecting arrangement.

6. The power operated dispensing tool of claim 1 wherein said housing and attachment assembly are made from a polymeric material.

7. The power operated dispensing tool of claim 3 wherein said elongated opening of at least one of said plurality of different sized housing having different diameters includes a housing and corresponding elongated opening large enough to nest another of said plurality of different sized housings within the elongated opening during storage.

8. The power operated dispensing tool of claim 1 wherein said different sized housings comprise housings having diameters of different size.

9. The power operated dispensing tool of claim 1 wherein said different sized housings comprise housings having lengths of different size.

10. A kit for use by tooless attachment with a power apparatus for dispensing material, the kit comprising:

a plurality of different sized housings having different diameters, lengths, and outer housing profiles of both uniform and perforated shaped housing walls for supporting varying size and differently shaped cartridge types filled with materials for dispensing, the plurality of different sized housings having a material dispensing end and an equally sized attachment end for connecting to a power apparatus for dispensing material during use.

11. The kit of claim 10 wherein one of said plurality of different sized housings comprises a sausage type housing.

12. The kit of claim 10 wherein one of said plurality of different sized housings comprises an elongated opening for receiving the cartridges.

13. The kit of claim 10 wherein one of said plurality of different sized housings comprises a housing having a diameter that is larger than a diameter forming an outer diameter of its corresponding attachment end.

14. The kit of claim 10 wherein one of said plurality of different sized housings comprises a housing having a diameter substantially the same as a diameter forming of its corresponding attachment end.

15. The kit of claim 10 wherein one of said plurality of different sized housings and its corresponding attachment end are made from a polymeric material.

16. The kit of claim 12 wherein said elongated opening of at least one of said plurality of different sized housing having different diameters includes a housing and corresponding elongated opening large enough to nest another of said plurality of different sized housings within the elongated opening during storage.

17. A method of interchanging cartridge support tubes for a power dispensing apparatus without the need or use of tools, the method comprising;

providing a body portion for supporting a rod connected to a piston for engaging and advancing material from the power dispensing apparatus during operation, the body portion comprising a first connecting arrangement having a first set of threads annularly located about a surface of said first connecting arrangement;

selecting one of a plurality of different sized cartridge support tubes having different diameters and/or lengths for supporting varying size material containers, each of said plurality of different sized cartridge support tubes comprising a second connecting arrangement having a second set of threads annularly located about a surface of said second connecting arrangement;

rotationally engaging said first set of threads of said body portion with said second set of threads of a select one of said plurality of different sized cartridge support tubes to form a desired powered dispensing apparatus.

18. The method of claim 17 further comprising rotationally disengaging said first set of threads of said body portion with said second set of threads of said select one of said plurality of different sized cartridge support tubes allowing for an interchange of said body portion with another of said select one of said plurality of different sized cartridge support tubes.

19. The method of claim 17 wherein at least one of said plurality of different sized cartridge support tubes comprises an elongated radial opening for radially receiving cartridges.

20. The method of claim 19 wherein at least one of said plurality of different sized cartridge support tubes comprises a sausage type cartridge support tube.

* * * * *